US008784000B2

(12) United States Patent
Reynolds et al.

(10) Patent No.: US 8,784,000 B2
(45) **Date of Patent: *Jul. 22, 2014**

(54) EXPLOSION MITIGATING COVER

(71) Applicant: EJ USA, Inc., East Jordan, MI (US)

(72) Inventors: Dean W. Reynolds, Elmira, MI (US); James R. Allen, Bellaire, MI (US); Jeremy I. Johnson, East Jordan, MI (US)

(73) Assignee: EJ USA, Inc., East Jordan, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/940,698

(22) Filed: Jul. 12, 2013

(65) Prior Publication Data

US 2014/0169876 A1 Jun. 19, 2014

Related U.S. Application Data

(63) Continuation-in-part of application No. 13/713,754, filed on Dec. 13, 2012.

(51) Int. Cl.
*E02D 29/14* (2006.01)

(52) U.S. Cl.
USPC ..... 404/25

(58) Field of Classification Search
USPC ..... 404/25, 26; 137/371; 52/19
See application file for complete search history.

(56) References Cited

U.S. PATENT DOCUMENTS

| | | | |
|---|---|---|---|
| 1,955,018 | A | 4/1934 | Rego |
| 2,025,839 | A | 12/1935 | Woods, Jr. |
| 3,712,009 | A | 1/1973 | Campagna |
| 4,761,319 | A | 8/1988 | Kraus et al. |
| 6,350,081 | B1 | 2/2002 | Khajavi et al. |
| 6,551,015 | B1 | 4/2003 | Khajavi et al. |
| 7,484,908 | B2 | 2/2009 | Stadler |
| 7,540,683 | B2 | 6/2009 | Salas |
| 7,559,717 | B2 | 7/2009 | Salas |
| 7,712,995 | B2 | 5/2010 | Stadler |
| 7,922,033 | B2 | 4/2011 | Kearby et al. |
| 2013/0089373 | A1 | 4/2013 | Bax |

OTHER PUBLICATIONS

EJIW Drawing for Product No. 00370402, dated Sep. 9, 2004.
EJIW Drawing for Product No. 00102015, last revised Jun. 10, 2008.
EJIW Drawing for Product No. 00115421, last revised Jul. 28, 2008.
EJIW Drawing for Product No. 00115411, last revised Oct. 10, 2008.
EJIW Drawing for Product No. 00148383 last revised Sep. 19, 2012.
EJIW Drawing for Product No. 00188879A01 last revised Apr. 1, 2013.

*Primary Examiner* — Gary Hartmann
(74) *Attorney, Agent, or Firm* — Warner Norcross & Judd LLP

(57) ABSTRACT

A manhole cover assembly configured to behave as a relief valve in an explosion event, opening so that fluid, such as air or explosive gas, may vent from an underground area. The manhole cover assembly may include a manhole cover and a frame, and may be configured to limit movement of the manhole cover with respect to the frame in response to increased pressure on the manhole cover. In one embodiment, the manhole cover may include legs having angled surfaces adapted to substantially center or guide the manhole cover in the frame while the manhole cover displaces to release pressure. In another embodiment, one or more legs slidable within the manhole cover to enable configuring the manhole cover between a restraint mode and a removal mode.

20 Claims, 14 Drawing Sheets

EXPLOSION MITIGATING COVER

BACKGROUND OF THE INVENTION

The present invention relates to an explosion mitigating manhole cover, and more particularly to a manhole cover configured to release pressure in a directional manner and limit movement during an explosion event.

Manhole covers are well known. Generally, a manhole cover is a removable plate forming the lid over an opening providing access to an underground area also known as a manhole that may include utilities, pipes, cables and passages. The lid may, among other things, prevent someone from falling in and keep unauthorized persons out. Conventional manhole covers seat on a frame installed over the manhole, sometimes flush with the surface of a road. The frame may provide an interface for the manhole cover to seat over the manhole opening, and often times, is secured to the manhole or surrounding structure so that the manhole cover may be removed for access while the frame remains fixed in place.

Manhole covers often weigh more than 100 pounds, partly because the weight keeps them in place when traffic passes over them, and partly because they are often made out of cast iron, sometimes with infills of concrete. This makes them inexpensive and strong, but heavy.

Despite this weight, electrical or gas explosions in the area underneath the cover may unseat the manhole cover due to the sudden pressure build up from the explosion. In many cases, the explosion event moves the manhole cover so that the manhole is left fully or partially uncovered. And, in some explosion events, the manhole cover may become a projectile, flying up to 20 feet or more in the air. To address these potentially undesirable effects, manhole covers are sometimes bolted or fastened to the frame. This configuration, however, may not relieve the pressure from an explosion event, thereby potentially causing structural damage to the underground area or to surrounding surface structure, such as the road.

More recently, manhole cover and frame assemblies have been developed to release explosive pressure in a controlled fashion. These assemblies behave similar to a relief valve by allowing the manhole cover to rise in response to explosive pressure and to then reseat once the pressure has subsided. This way, the manhole cover may not become a projectile, or leave the manhole uncovered, in response to an explosive event. One type of manhole cover restraint configured to release explosive pressure in a controlled fashion is available on the market under the brand name Swiveloc. This manhole cover includes a locking lug and an extendable latch construction that interface with a manhole frame to restrain the manhole cover during an explosive event. However, this cover assembly is not without drawbacks. Although the locking lug appears to be a simple component, the extendable latch includes multiple interfitting components, which add expense to the overall product and may become susceptible to failure over time.

SUMMARY OF THE INVENTION

The present invention provides a manhole cover assembly configured to behave as a relief valve in an explosion event, enabling opening of the cover in response to such an event so that fluid, such as air or explosive gas, may vent from the area underneath the cover. The manhole cover assembly may include a manhole cover and a frame, and may be configured to limit movement of the manhole cover with respect to the frame in response to increased pressure on the manhole cover. For example, the manhole cover assembly may be configured to allow limited vertical displacement of all or a portion of the manhole cover with respect to the frame, thereby allowing pressure to release from the underground area through the access opening.

In one embodiment, for example, the manhole cover may include legs having angled surfaces adapted to guide or substantially center the manhole cover in the frame as the manhole cover displaces to release pressure. In another embodiment, one or more legs may be at least one of (a) pivotable with respect to the manhole cover and (b) slidable within the manhole cover. This may enable configuring the manhole cover between a restraint mode and a removal mode, where the restraint mode may prevent complete removal of the manhole cover from the frame and the removal mode may allow complete removal.

In one embodiment, the legs may extend away from an underside of the manhole cover and toward an access opening of the underground area. Each of the legs may include a foot at a first end thereof and that extends toward a peripheral wall of the frame. The feet may contact the frame, limiting displacement of the manhole cover with respect to the frame in response to pressure on the underside of the frame. For example, the feet may contact a flange or ridge on the peripheral wall of the frame preventing the manhole cover from further vertical displacement with respect to the frame.

In one embodiment, the manhole cover may include an opening through which a leg may slide in a removal mode, and within which the leg may be anchored to the manhole cover in a restraint mode. For example, in the restraint mode, a lug end of the leg may be anchored to the manhole cover preventing the cover from being removed from the frame. In the removal mode, the leg may slide freely within the opening to enable removal of the cover. A projection at the lug end of the leg and a pin disposed at an opposite end of the leg may prevent the leg from being decoupled from the manhole cover.

In another embodiment, pivotable legs coupled to the manhole cover may be configurable between the removal mode and the restraint mode. The legs may pivot freely toward the peripheral wall of the frame but not in the opposite direction beyond a pivot stop. In this way, the legs may interface with the peripheral wall in the restraint mode to limit movement of the manhole cover with respect to the frame, and may enable the manhole cover to be removed from the frame when configured in the removal mode.

For example, the pivotable legs may rotate up to 90 degrees between the pivot stop and the underside adjacent a peripheral edge of the manhole cover. Two legs disposed near each other and configured to pivot in this manner may enable horizontal displacement of the manhole cover in one direction (e.g. a removal direction) while preventing such displacement in the other direction. A third leg being configurable to prevent horizontal displacement in the removal direction may therefore maintain the manhole cover in the restraint mode. This third leg may also be configurable in the removal mode to allow movement in the removal direction, thereby enabling the two legs to pivot and complete removal of the manhole cover from the frame.

In another embodiment, the manhole cover adapted for angular movement when acting as a relief valve. Such an assembly includes a cover having an upper surface, an outer peripheral edge, and first and second legs extending from the cover. The legs including radially outwardly extending feet aligned underneath the frame. One of the legs is shorter than the other legs to provide the cover with a range of angular movement.

In a more particular version of this embodiment, the cover defines an opening extending through the cover and one of the legs extends through the opening in the cover, wherein the upper end includes a lug and the lower end includes a foot extending outwardly from the leg and underneath a portion of the frame, wherein the first leg is slidably movable within the cover opening to a closed position wherein the lug engages the cover and the foot is spaced at a vertical distance below the underside of said cover with the foot extending radially outwardly underneath the frame such that in response to increased pressure a first portion of the cover has a range of movement with respect to the cover receiving flange that is capable of providing a vertical clearance between the first portion of the cover and the frame to enable the escape of fluids through the access opening, wherein the foot contacts the frame at a limit of the range to prevent the first portion of the cover from moving beyond the limit of the range. As noted below, this embodiment may provide advantages in that it can enable the ability to limit the direction of flow of any gases, flames or fluids will escape the manhole during an explosion or other high pressure event.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

I. Overview

Figure 1:
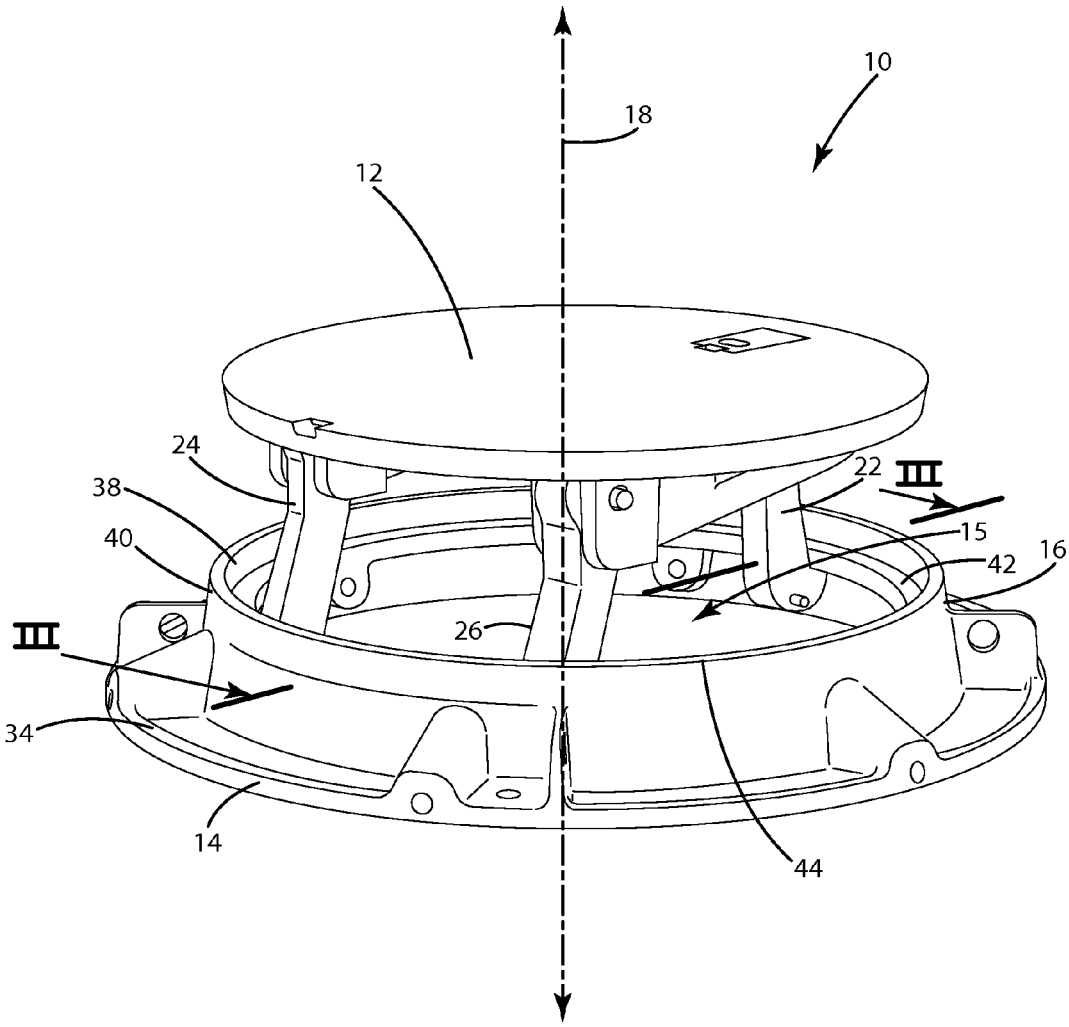
FIG. 1 is a perspective view of a manhole cover assembly according to a current embodiment.

A manhole cover assembly according to one embodiment of the present invention is shown in FIGS. 1-3 and 6 and generally designated 10. The manhole cover assembly 10 generally includes a manhole cover 12 and frame 14 adapted to support the manhole cover 12. The manhole cover 12 is configured to behave as a relief valve in an explosion event, opening so that fluid, such as air, explosive gas, or another gas, may vent through the manhole cover assembly 10. The manhole cover 12 is configured to limit its movement with respect to the frame 14 in response to increased pressure on the manhole cover 12 and to then return to a seated position once the pressure has subsided. In the illustrated embodiment, the manhole cover 12 includes legs 22, 24, 26 that, when in a locked position (e.g., a restraint mode), may engage the frame 14 to limit displacement of the manhole cover 12 with respect to the frame 14. For example, as shown in the illustrated embodiment of FIG. 1, the manhole cover 12 is fully open with the legs 22, 24, 26 engaged with the frame 14, preventing further vertical displacement of the manhole cover 12 along a central axis 18 of the frame 14 and allowing fluid to flow through the access opening 15. And, in the illustrated embodiment of FIG. 2, the manhole cover 12 is fully closed or seated with the legs 22, 24, 26 disengaged from the frame 14, enabling vertical movement of the manhole cover 12 along the central axis 18 of the frame 14.

The legs 22, 24, 26 may be configurable from the restraint mode to a removal mode, in which one or more of the legs 22, 24, 26 are adapted to pivot, release, or a combination thereof, in order to clear the frame 14 and enable removal of the manhole cover 12 from the frame 14. Further, in the removal mode, one or more legs 22, 24, 26 may also slide partially through an opening 58 in the manhole cover 12, allowing the one or more legs to be used as a handle for removing the manhole cover 12 from the frame 14. Although described in connection with a manhole cover 12 having two legs 24, 26 capable of pivoting to clear the frame 14, and one leg 22 adapted to slide partially through the opening 58 to clear the frame 14 and to be used as a handle, it should be understood that the present invention is not limited to this configuration. The manhole cover 12 may have any number of legs that slide partially and any number of legs adapted to pivot. In another alternative embodiment, the manhole cover 12 may have one or more legs that slide partially through a frame opening to clear the frame 14 without legs capable of pivoting. And in other alternative embodiments, the manhole cover 12 may have one or more legs adapted to pivot to enable removal without legs that partially slide through a frame opening.

II. Structure

The described embodiment may be used as a manhole cover assembly 10 to cover an access opening 15 and to provide access to an infrastructure, such as a drainage or sewer infrastructure system, underneath the opening 15. Although the manhole cover assembly 10 may be installed over any suitable hole, it will often be installed over a manhole in a street or sidewalk. As noted above, the manhole cover assembly generally includes a frame 14 and a cover 12, each of which is described in more detail below.

Figure 2:
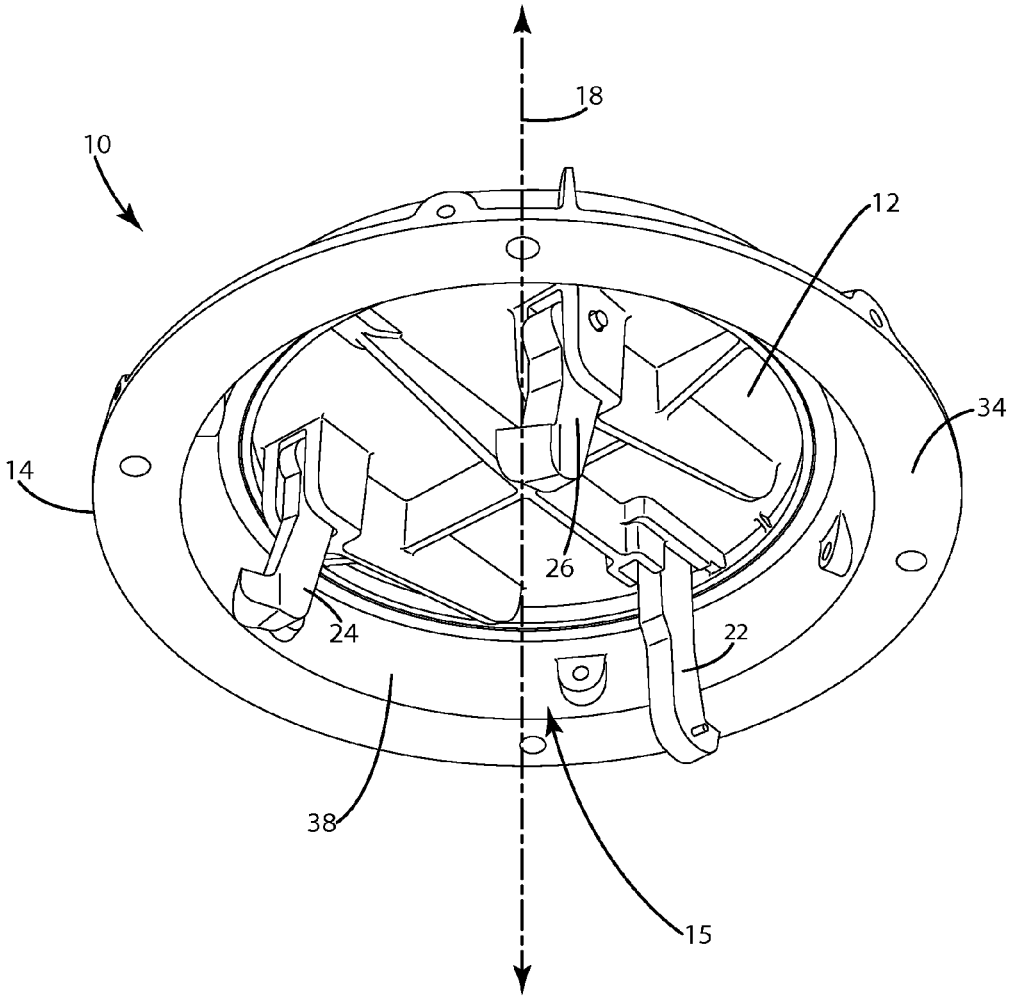
FIG. 2 is a bottom perspective view of the manhole cover assembly in a seated position according to the current embodiment.
Figure 3:
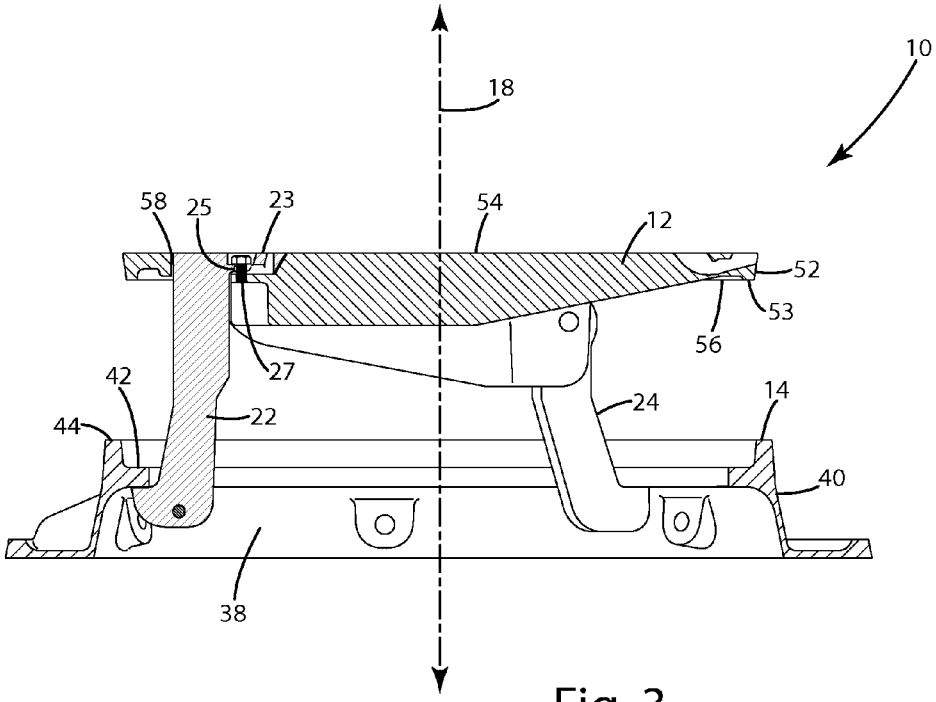
FIG. 3 is a sectional view of the manhole cover assembly according to the current embodiment.

In the illustrated embodiments of FIGS. 1 and 2, the frame 14 is a generally peripheral structure including a base 34, and a peripheral wall 16 extending upwardly from the base 34 including an inner surface 38 and an outer surface 40. The inner surface 38 of the illustrated embodiment may include a cover receiving support 42 configured as a flange to support the manhole cover 12 in a seated position. The described frame 14 is annular and may be installed over a manhole (not shown), but it should be appreciated that the frame 14 may be any shape, including rectangular or square. The configuration of the top edge 44, inner surface 38, and cover receiving support 42 may be selected to interface with the cover 12 to cover the manhole opening. Alternatively, a supporting surface other than the cover receiving support 42, such as the top edge 44 of the frame 14, may support the manhole cover 12 in a seated position to cover the manhole opening 15. In one embodiment, the frame 14 is installed flush with the surface of a road 8 and fastened to the manhole opening 15 using anchor bolts or angled anchor rods fastened to either the underground area or surrounding road 8. The frame 14 may also include cast-in bolts for securing the frame 14 to the manhole opening 15. The frame 14 may be a pre-existing frame already installed to cover the manhole opening 15.

Figure 4:
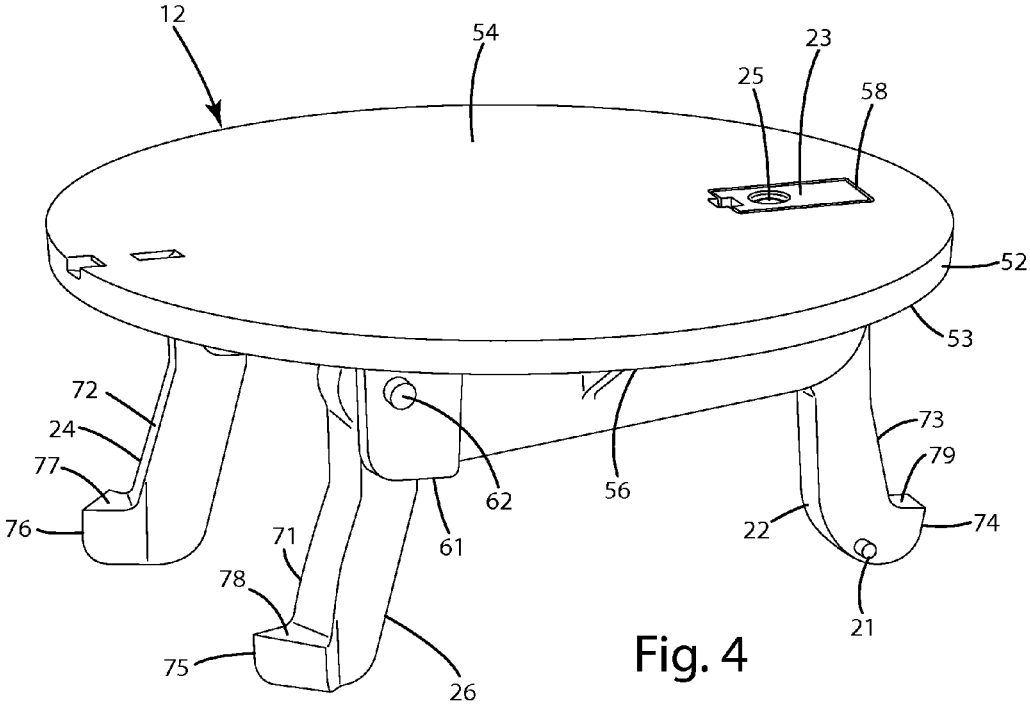
FIG. 4 is a top perspective view of a manhole cover according to the current embodiment.
Figure 5:
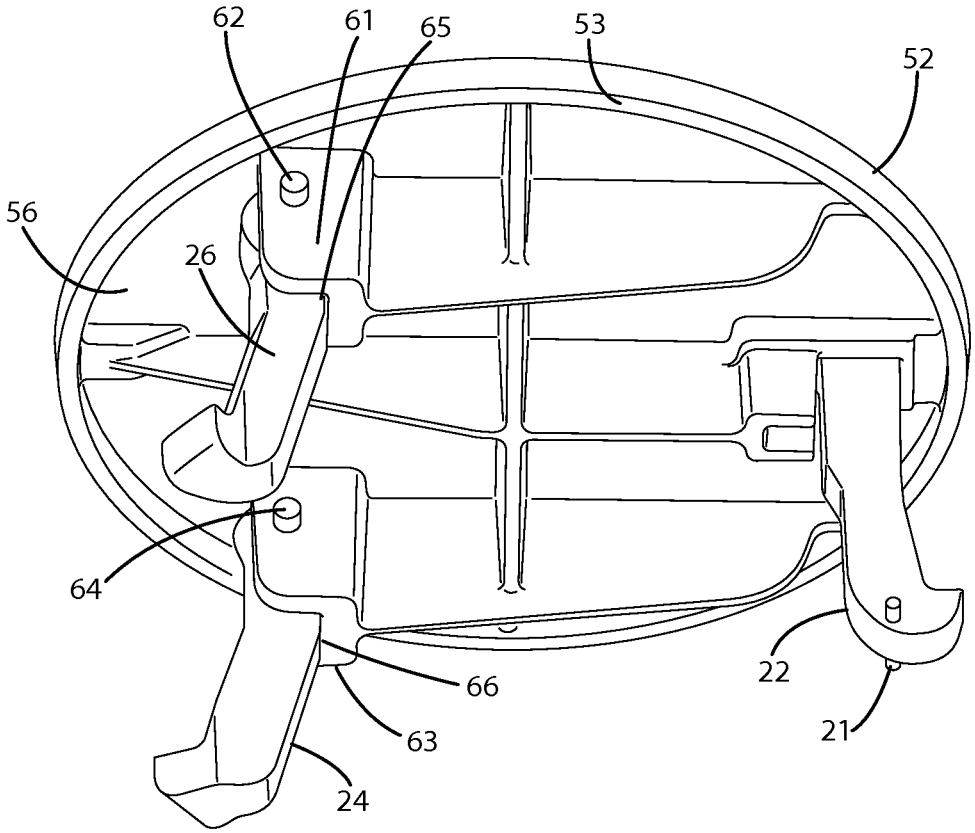
FIG. 5 is a bottom perspective view of the manhole cover according to the current embodiment.
Figure 6:
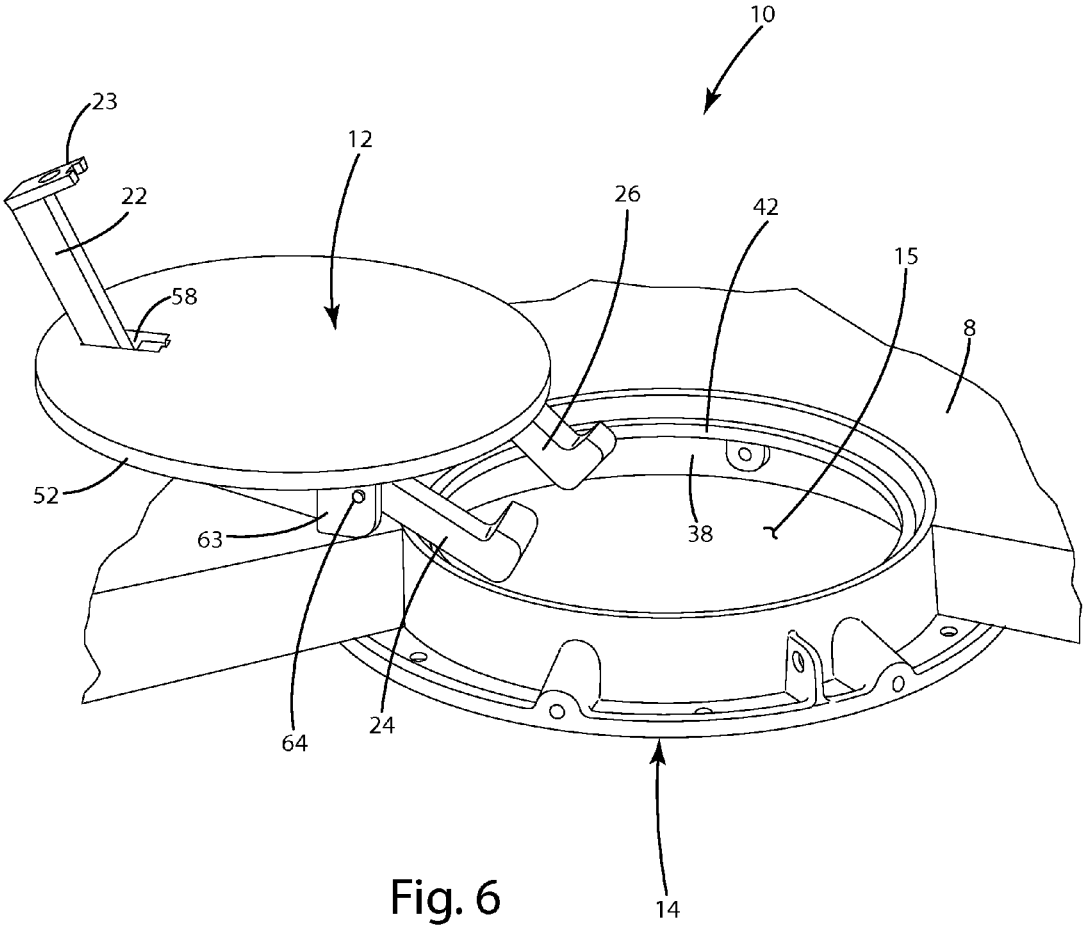
FIG. 6 is a perspective view of the manhole cover being removed from a frame according to the current embodiment.
Figure 7:
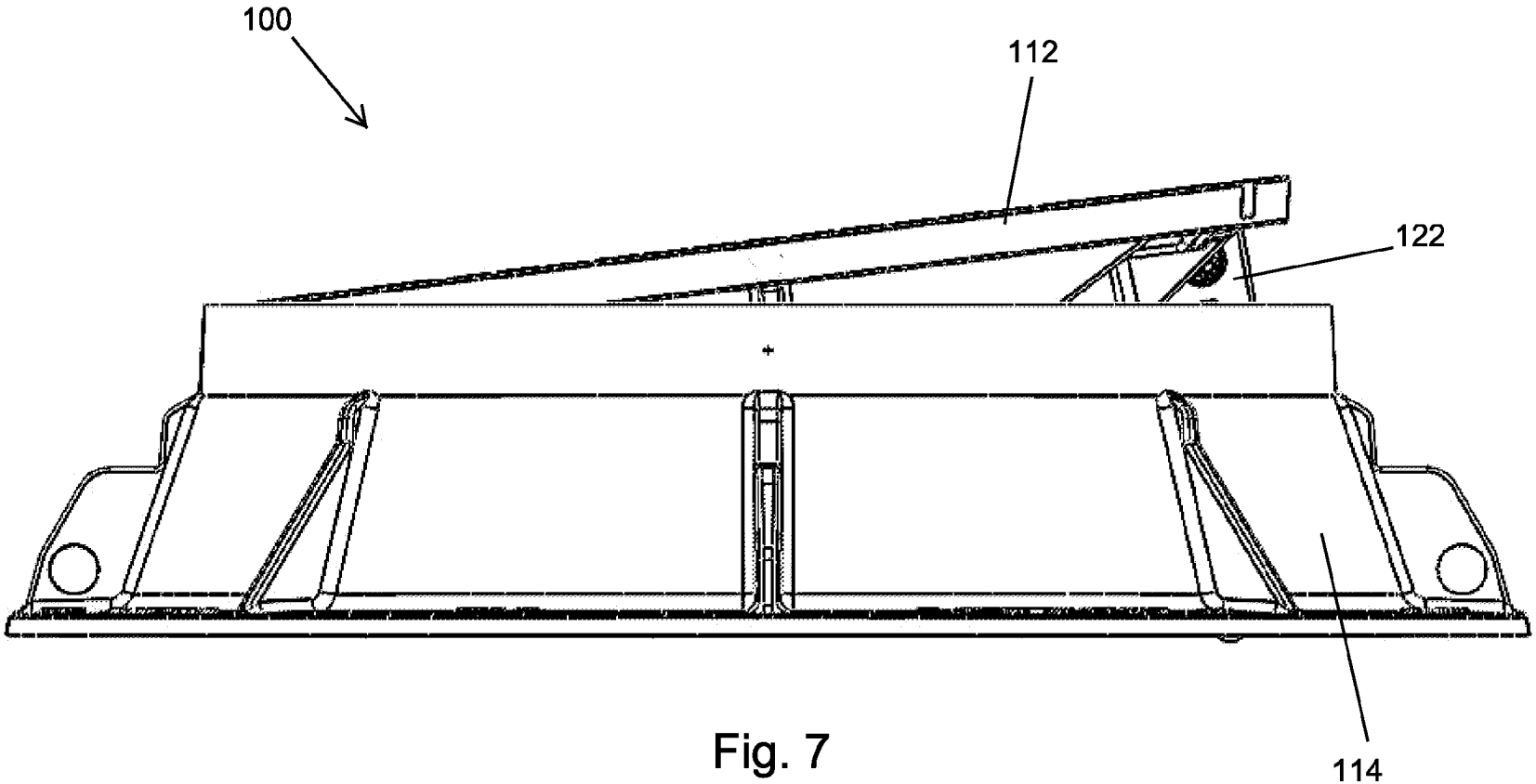
FIG. 7 is a side view of a manhole cover and frame according to a second embodiment of the present invention with the cover in a partially open position.
Figure 8:
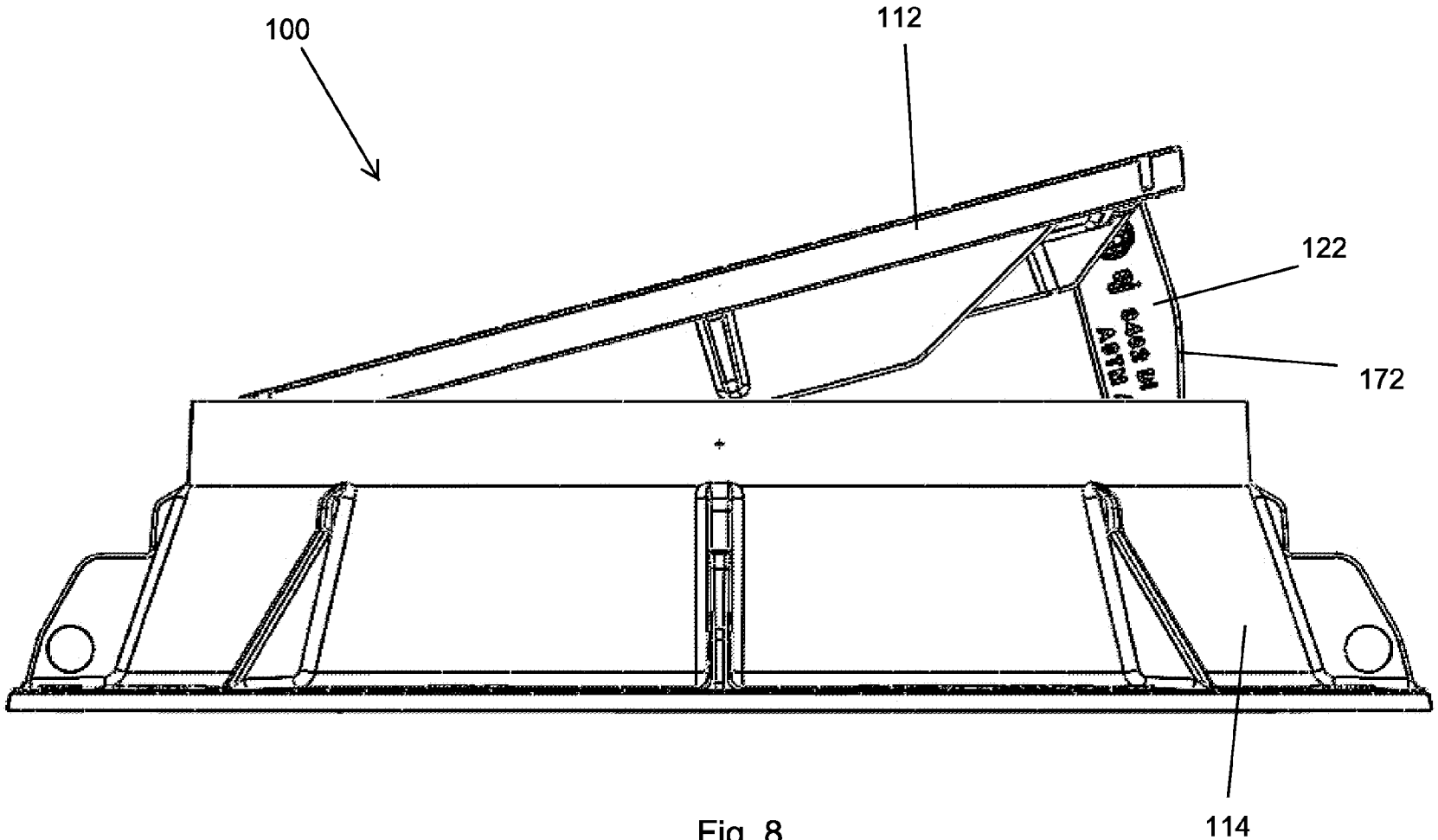
FIG. 8 is a side view of a manhole cover and frame according to a second embodiment of the present invention with the cover in an open position.
Figure 9:
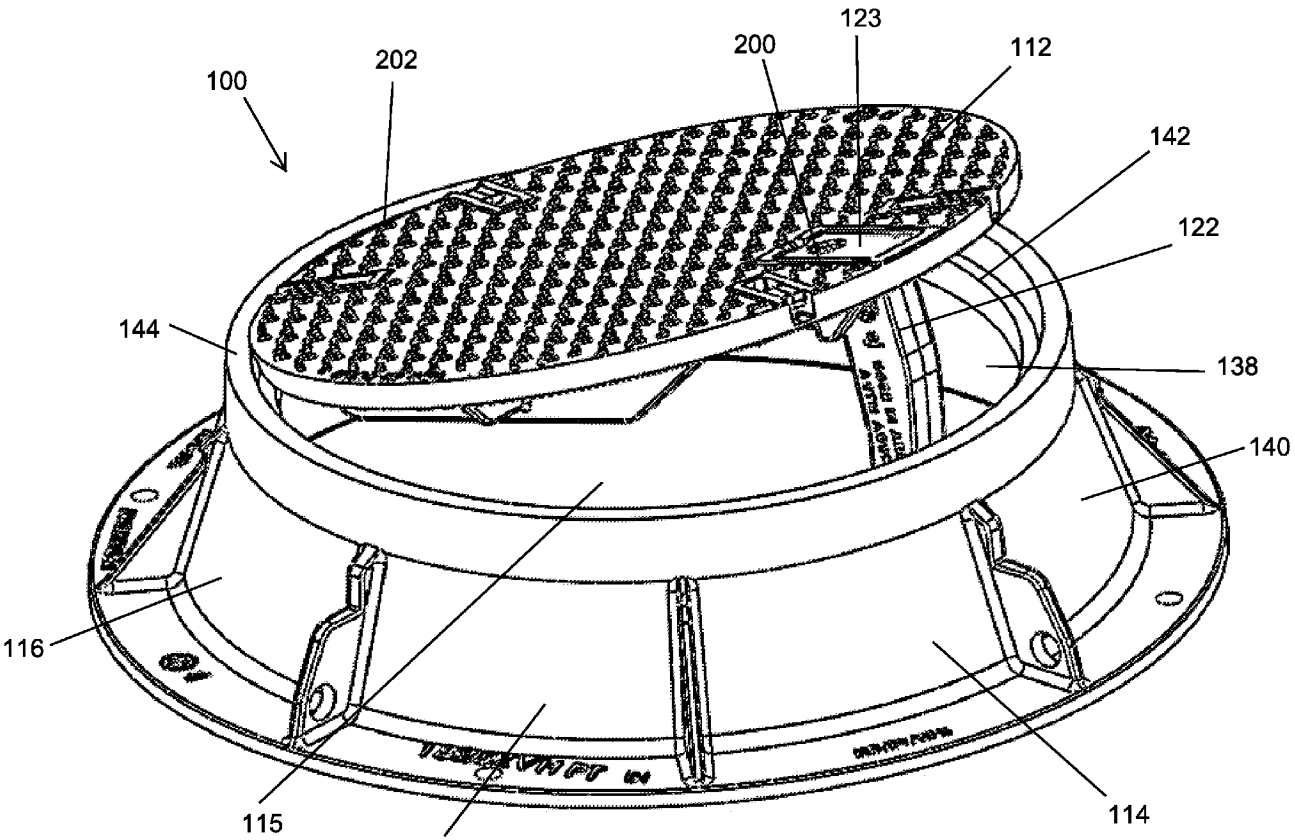
FIG. 9 is a perspective view of a manhole cover and frame according to a second embodiment of the present invention with the cover in an open position.

Turning to the cover 12 of the illustrated embodiments shown in FIGS. 1-6, the cover 12 is depicted having a round shape to match the generally annular shape of the frame 14 and peripheral wall 16. Alternatively, the cover 12 may have a different shape to cover a variety of differently sized access openings and to interfit with a variety of differently sized frames 14. The cover 12 includes a peripheral edge 52, an upper surface 54 and an underside 56. The underside 56 may include a seating surface 53 adjacent to the peripheral edge 52 and that interfaces with a supporting surface of the frame 14, such as the cover receiving support 42, in a seated position. The cover 12 may include control legs 22, 24, 26 configurable between two modes: a removal mode and a restraint mode. The illustrated embodiment includes three control legs 22, 24, 26, but there may be more or fewer legs in alternative embodiments. As shown in the illustrated embodiments of FIG. 1-5, the legs 22, 24, 26 are configured in the restraint mode such that movement of the cover 12 with respect to the frame 14 may be limited. For example, the manhole cover 12 may move from a seated position as shown in FIG. 2 to an unseated position as shown in FIG. 1. The illustrated embodiment of FIG. 6 shows the cover 12 configured in a removal mode, enabling the cover 12 to be removed from the frame 14.

In the illustrated embodiments of FIGS. 1-5, each of the legs 22, 24, 26 includes respectively an angled-guide surface 71, 72, 73 and a foot 74, 75, 76. The angled-guide surface and feet may be integrally cast as part of each leg during manufacture. The feet 74, 75, 76 extend outwardly toward the peripheral edge 52 of the cover 12, and each may include a frame-stop surface 77, 78, 79 that may be configured to contact the frame 14 in order to limit vertical displacement of the cover 12 with respect to the frame 14 along the central axis 18. For example, the feet 74, 75, 76 may contact the underside of the frame supporting surface 47 limiting movement of the cover 12 in an explosion event. It should be understood that the legs 22, 24, 26 may not include angled-guide surfaces 71, 72, 73 in an alternative embodiment. For example, the angled-guide surfaces 71, 72, 73 may not be angled.

As described herein, in the restraint mode and with the cover 12 seated on the frame 14, the cover 12 may displace vertically with respect to the central axis 18 as pressure rises on the underside 56 of the cover 12, thereby behaving as a relief valve to allow fluid through the access opening 15. As the cover 12 displaces vertically, the angled guide surfaces 71, 72, 73 may interface with the inner surface 38 of the frame 14 to guide the cover 12 toward the center of the frame 12. In the illustrated embodiment, the cover 12 is capable of displacing up to 8 inches vertically along the central axis 18 from a seated position on the frame 14. The range over which the cover 12 is capable of moving may vary from application to application depending on the desired pressure release capability of the manhole cover assembly 10. For example, if a lower maximum pressure release is anticipated, then the distance between the seating surface 53 and the frame-stop surfaces 77, 78, 79 may be decreased so that the cover 12 is capable of displacing up to 4 inches instead of 8 inches, decreasing the maximum allowable fluid flow. Alternatively, if higher maximum pressure release is anticipated, then the vertical displacement capability of the cover 12 may be increased in order to allow greater fluid flow. The range may also vary depending on other constraints, such a displacement height limitation.

Detailed views of the manhole cover 12 configurable between a removal mode and a restraint mode are shown in the illustrated embodiments of FIGS. 4-6. In particular, the control legs 22, 24, 26 may be configurable between a removal mode and a restraint mode. In either mode, two of the control legs 24, 26 may be pivotally mounted to the underside 56 of the cover 12, though a greater or fewer number of control legs may be pivotally mounted in alternative embodiments. The underside 56 of the cover 12 may include mounting flanges 61, 63 and pins 62, 64 capable of pivotally receiving the legs 24, 26. The mounting flanges 61, 63 respectively include a pivot stop 65, 66 and may be configured to allow the control legs 24, 26 to rotate approximately 90 degrees between the seating surface 53 and the pivot stops 65, 66. Alternatively, the manhole cover assembly 10 may be configured to enable more or less than 90 degree rotation of the control legs 24, 26 depending on the desired configuration. As illustrated, the pivot stops 65, 66 may prevent further rotation of the control legs 24, 26 beyond 90 degrees so that, in the restraint mode, the feet 75, 76 and angled-guide surfaces 71, 72 of the control legs 24, 26 interface with the frame 14 to limit movement of the cover 12.

One or more of the control legs, leg 22 in the illustrated embodiment, may be fixedly anchored to the cover 12 in the restraint mode while being slidably coupled to the cover 12 in the removal mode. The control leg 22 may include a projection 23, or lug, having a hole 25 capable of being fastened with an anchor bolt 27 to the cover 12 so that the control leg 22 is fixedly anchored to the cover 12. However, it should be understood that, in the current embodiment, the control leg 22 need not be fixedly anchored to the cover 12 in order to limit movement of the cover 12 with respect to the frame 14 in response to increased pressure. If the anchor bolt 27 or a fastener for the control leg 22 is misplaced, damaged or defective, the cover 12 and the control leg 22 may remain inherently capable of limiting movement of the cover 12. In other words, without the control leg 22 fixedly anchored to the cover 12, the cover 12 may be in the removal mode but still configured for limited movement during an explosion event. For instance, if the anchor bolt 27 is not present, the projection 23 may interface with the cover 12 to enable the cover 12 to behave as a relief valve.

As illustrated, the cover 12 may include a control leg anchor opening 58 defining an opening through the cover 12 from the upper surface 54 to the underside 56. The control leg 22 may slide within this opening 58 in the removal mode so that the control leg 56 can be slid up and away from the frame 14, thereby enabling removal of the cover 12 from the frame 14. For example, by using the projection 23 as a handle to pull the cover 12 from the frame 14, the control legs 24, 26 may rotate toward the seating surface 53, thereby freeing the cover 12 from the frame 14 so that it can be removed. The control leg 22 may include a pin 21 that prevents the control leg 22 from sliding completely through the opening 58 in the removal mode. This pin 21 may be installed during manufacture after the control leg 22 is inserted through the opening 58.

II. Operation

In operation, the cover 12 of the illustrated embodiment may be configured between two modes: a restraint mode and a removal mode. In the restraint mode, the cover 12 may behave as a relief valve, displacing vertically in response to a pressure on the underside 56 exceeding a threshold and enabling fluid to vent through the access opening 15. The cover 12 may return to a seated position on the frame 14 after the pressure has subsided. In this way, if an explosion event occurs, damage to the manhole cover assembly 10 and surrounding structure, such as the road 8 or the underground area, may be prevented or mitigated. The pressure threshold resulting in displacement of the cover 12 may vary from application to application, generally depending on the weight of the cover 12, and to the extent there are other fluid paths from the underground area.

To place the cover 12 in the restraint mode, the pivotable control legs 24, 26 may be placed within the access opening 15 such that they hang, possibly resting against the pivot stops 65, 66. The seating surface 53 of the underside 56 may be positioned to rest on the cover receiving support 42 of the frame 14. Next, the control leg 22 may slide within the control leg anchor opening 58 until the projection 23 of the control leg 22 contacts the upper surface 54 of the cover 12. An anchor bolt 27 may fasten the control leg 22 to the cover 12 so that the control leg 22 is stationary. It should be appreciated that fastening systems other than an anchor bolt 27 may be used to anchor the control leg 22 to the cover 12, and that the present invention is not limited to using an anchor bolt 27. Further, in one embodiment, the anchor bolt 27 or other fastener may be configured to be tamper resistant so that the cover 12 may be considered an unauthorized access deterrent. As an example, in embodiments in which the anchor bolt 27 is a bolt, the bolt may be a penta-head bolt or another bolt type capable of deterring unauthorized access.

With the cover in the restraint mode, the cover 12 may have a limited range of movement with respect to the frame 14 such that it may behave as a relief valve. The cover 12, however, may not be removed completely from the frame 14 without being reconfigured into the removal mode. For example, the feet 74, 75, 76 may interfere with a portion of the frame 14 preventing vertical movement of the cover 12 beyond a certain point with respect to the frame 14. A portion of the peripheral wall 16 of frame 14, such as a flange, may be circular, and the feet 74, 75, 76 may be arranged such that a circle circumscribed about the feet 74, 75, 76 has a diameter larger than an inner diameter of the peripheral wall 16. A circle circumscribed about the angled-guide surfaces 71, 72, 73, however, may have a diameter less than that of the peripheral wall 16. In this way, the angled-guide surfaces 71, 72, 73 may enable the manhole to move vertically with respect to the frame, while the feet 74, 75, 76 limit this vertical movement by contacting the peripheral wall.

Removal of the cover 12 may be enabled by configuring the cover into the removal mode. In this mode, any fastener holding the control leg 22 in place may be loosened or removed so that the control leg 22 may clear the frame 14. The pivotable control legs 24, 26 may pivot toward the seating surface, shown for example in FIG. 6, in order to clear the frame as well. With the legs 22, 24, 26 in this configuration, the cover 12 may be removed from the frame 14 in order to access the manhole or underground area.

III. Second Embodiment

A second embodiment of the explosion mitigating manhole cover is shown in FIGS. 7-15 and generally designated 100. In this second embodiment, the manhole cover assembly 100 generally includes a manhole cover 112 and frame 114 adapted to support the manhole cover 112. As in the first embodiment, the manhole cover 112 is configured to behave as a relief valve in an explosion event, opening so that fluid, such as air, explosive gas, or another gas, may vent through the manhole cover assembly 100. The manhole cover assembly 100 varies from the first embodiment in that upon the pressure under the manhole cover 112 reaching a threshold, the manhole cover 112 lifts angularly—rather than strictly vertically—with respect to the frame 114. As in the first embodiment, the manhole cover 112 is configured to limit the movement of the cover 112 with respect to the frame 114 in response to increased pressure on the manhole cover 112 and to then return the opened portion of the cover 112 to a seated position once the pressure has subsided. In the illustrated embodiment of FIGS. 7-15, the manhole cover 112 includes legs 122 and 124 that, when in a locked position (e.g., a restraint mode), may engage the frame 114 to limit displacement of the manhole cover 112 with respect to the frame 114. The leg 122 may be longer than the leg 124, causing the cover 112 to displace angularly. For example, as shown in the illustrated embodiment of FIG. 10, the manhole cover 112 is fully open with the legs 122 and 124 engaged with the frame 114, preventing further angular displacement of the manhole cover 112 about an axis that generally extends through the support flange of the frame 114, about which the leg 124 rotates. This position allows fluid to flow through the access opening 115 and directs such flow in a particular direction defined by the positioning of the leg 122. And, in the illustrated embodiment of FIG. 12, the manhole cover 112 is fully closed or seated with the leg 122 disengaged from the frame 114, enabling angular movement of the manhole cover 112.

The legs 122 and 124 may be configurable from the restraint mode to a removal mode, in which one or more of the legs 122, 124 are adapted to pivot, release, or a combination thereof, in order to clear the frame 114 and enable removal of the manhole cover 112 from the frame 114. Further, in the removal mode, one or more legs 122, 124 may also slide partially through an opening 158 in the manhole cover 112, allowing the one or more legs to be used as a handle for removing the manhole cover 112 from the frame 114.

The frame 114 of the second embodiment is substantially similar to the frame 14 of the first embodiment and thus will not be described again in detail. In short, with reference to FIG. 9, the frame 114 includes a base 134, and a peripheral wall 116 extending upwardly from the base 134 including an inner surface 138 and an outer surface 140. The inner surface 138 of the illustrated embodiment may include a cover receiving support 142 configured as an inwardly extending flange to support the manhole cover 112 in a seated position with the underside of the cover 112 resting on the support flange 142. As noted in the first described embodiment, although the described frame 114 is annular and may be installed over a manhole (not shown), it should be appreciated that the frame 114 may be any shape, including rectangular or square. The configuration may be selected to interface with the cover 112 to cover the manhole opening. Alternatively, a supporting surface other than the cover receiving support 142, such as the top edge 144 of the frame 114, may support the manhole cover 112 in a seated position to cover the manhole opening 115. The frame 114 as described is for illustrative purposes only, as the cover 112 may be designed to retrofit onto many different types of frames 114 to convert those manhole cover assemblies into explosion mitigation assemblies.

The cover 112 is generally similar to that depicted in the first embodiment, having a round shape to match the generally annular shape of the frame 114 and peripheral wall 116. Alternatively, the cover 112 may have a different shape to cover a variety of differently sized access openings and to interfit with a variety of differently sized frames 114. The cover 112 includes a peripheral edge 152, an upper surface 154 and an underside 156. The underside 156 may include a seating surface 153 adjacent to the peripheral edge 152 that interfaces with a supporting surface of the frame 114, such as the cover receiving support 142, in a seated position.

Figure 10:
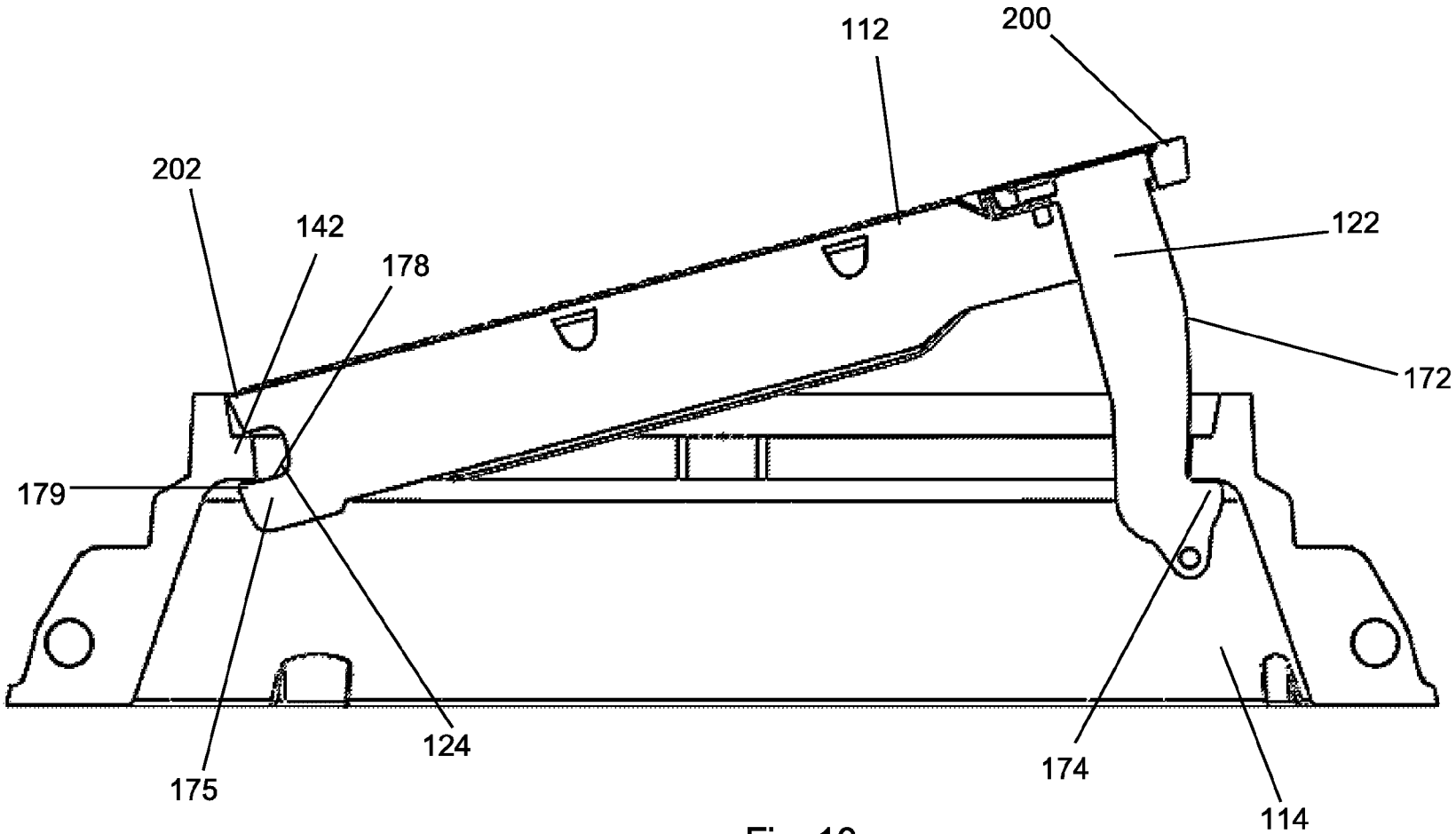
FIG. 10 is a side cross sectional view of a manhole cover and frame according to a second embodiment of the present invention with the cover in an open position.
Figure 11:
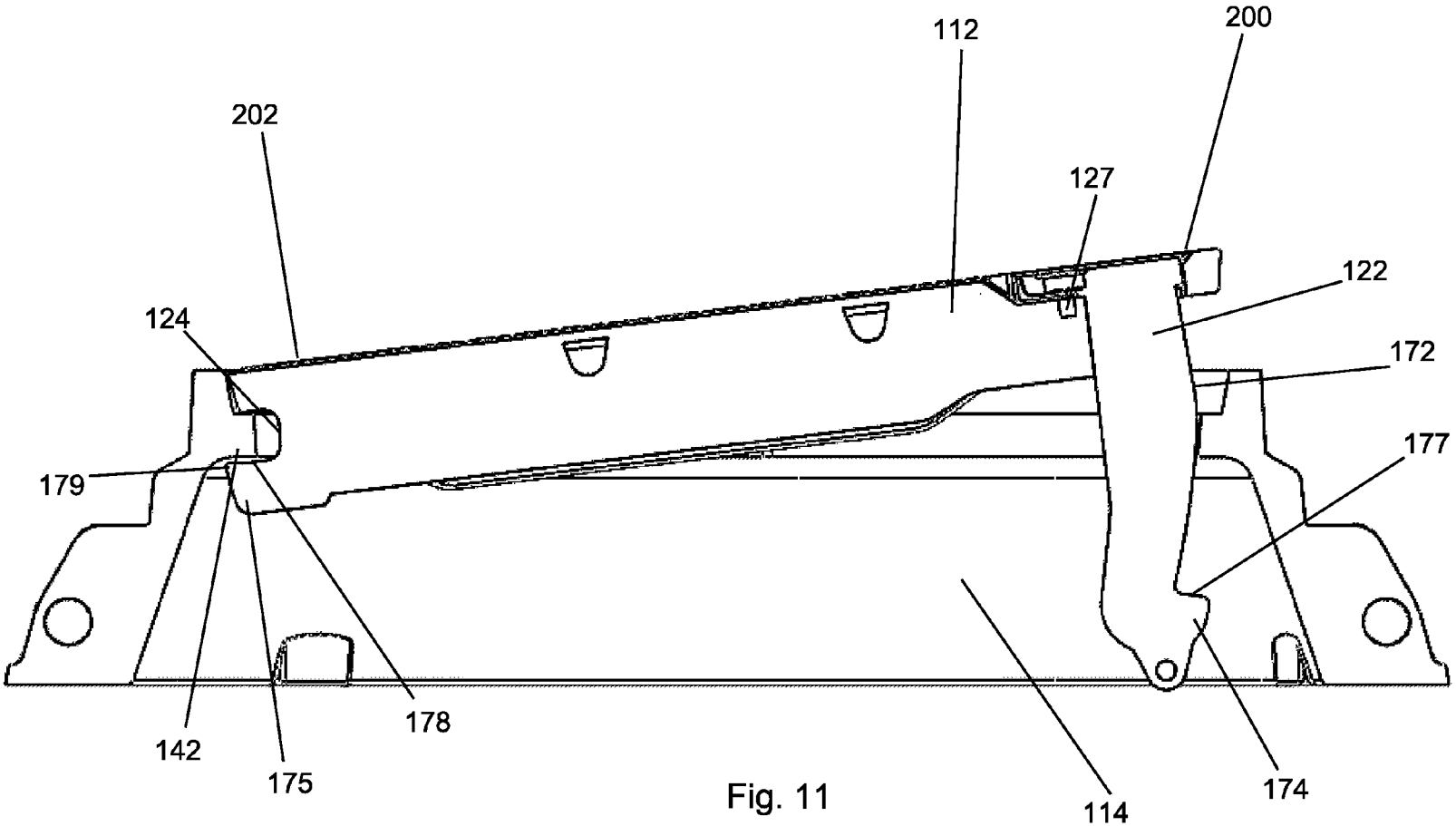
FIG. 11 is a side cross sectional view of a manhole cover and frame according to a second embodiment of the present invention with the cover in a partially open position.
Figure 12:
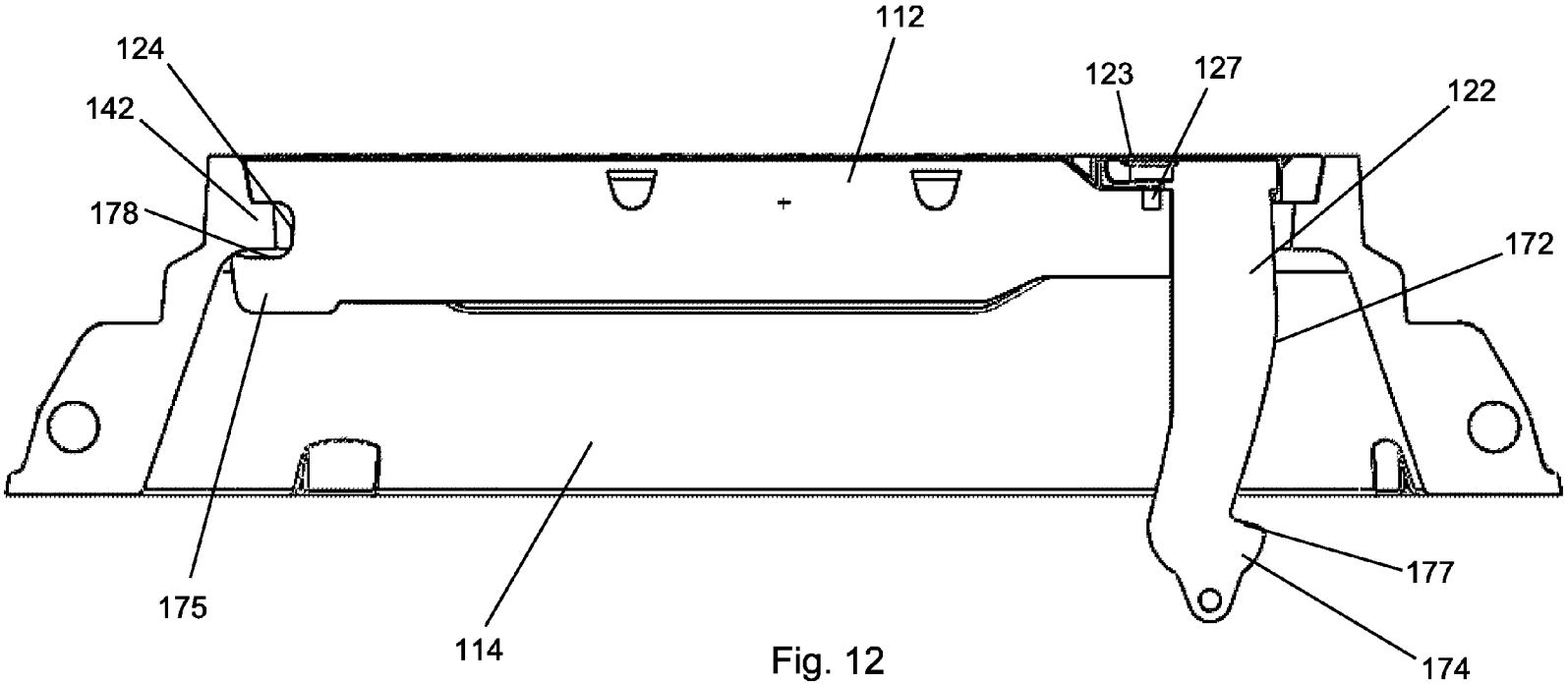
FIG. 12 is a side cross sectional view of a manhole cover and frame according to a second embodiment of the present invention with the cover in a closed position.
Figure 13:
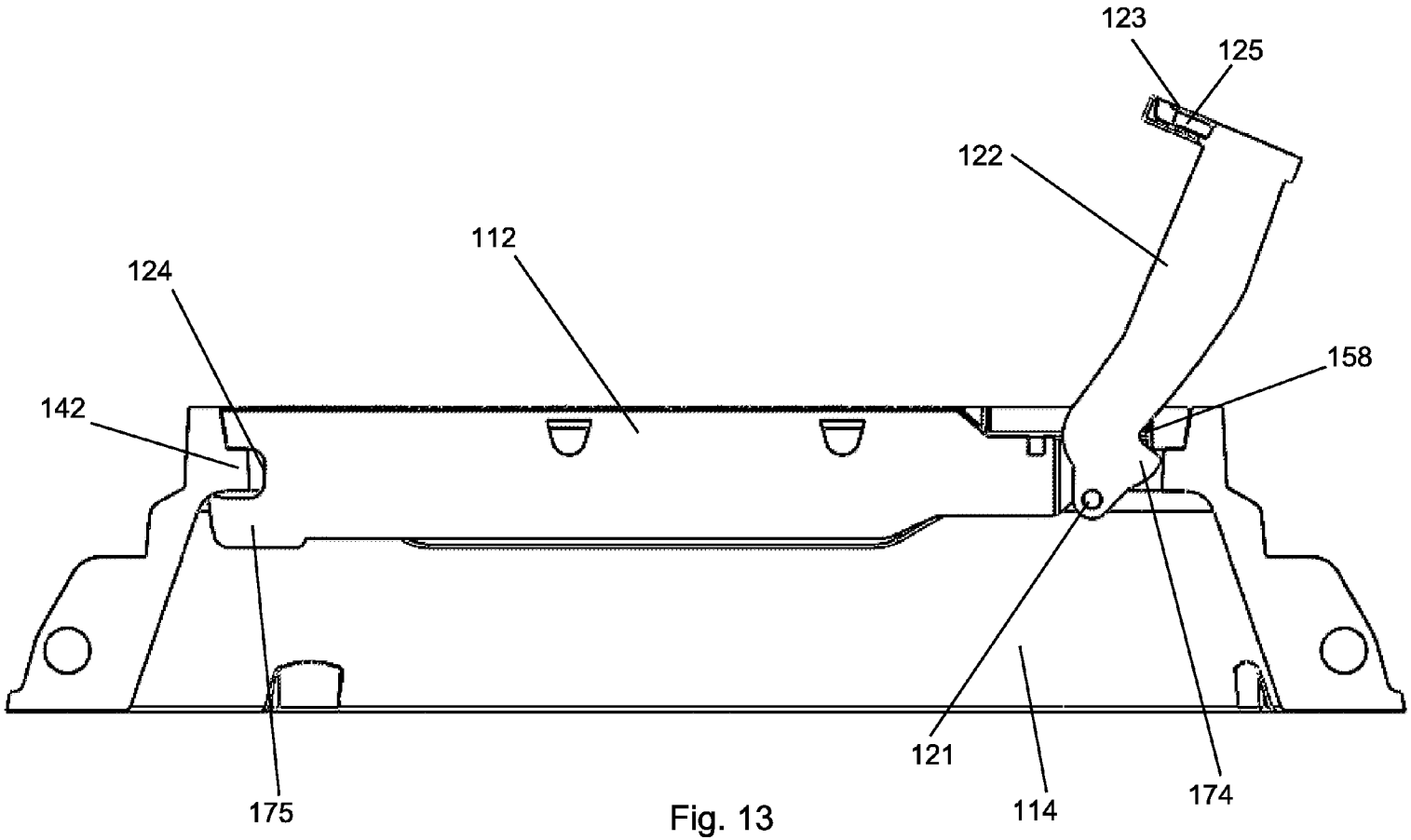
FIG. 13 is a side cross sectional view of a manhole cover and frame according to a second embodiment of the present invention with the cover in a closed position and a control leg in a removal mode.
Figure 14:
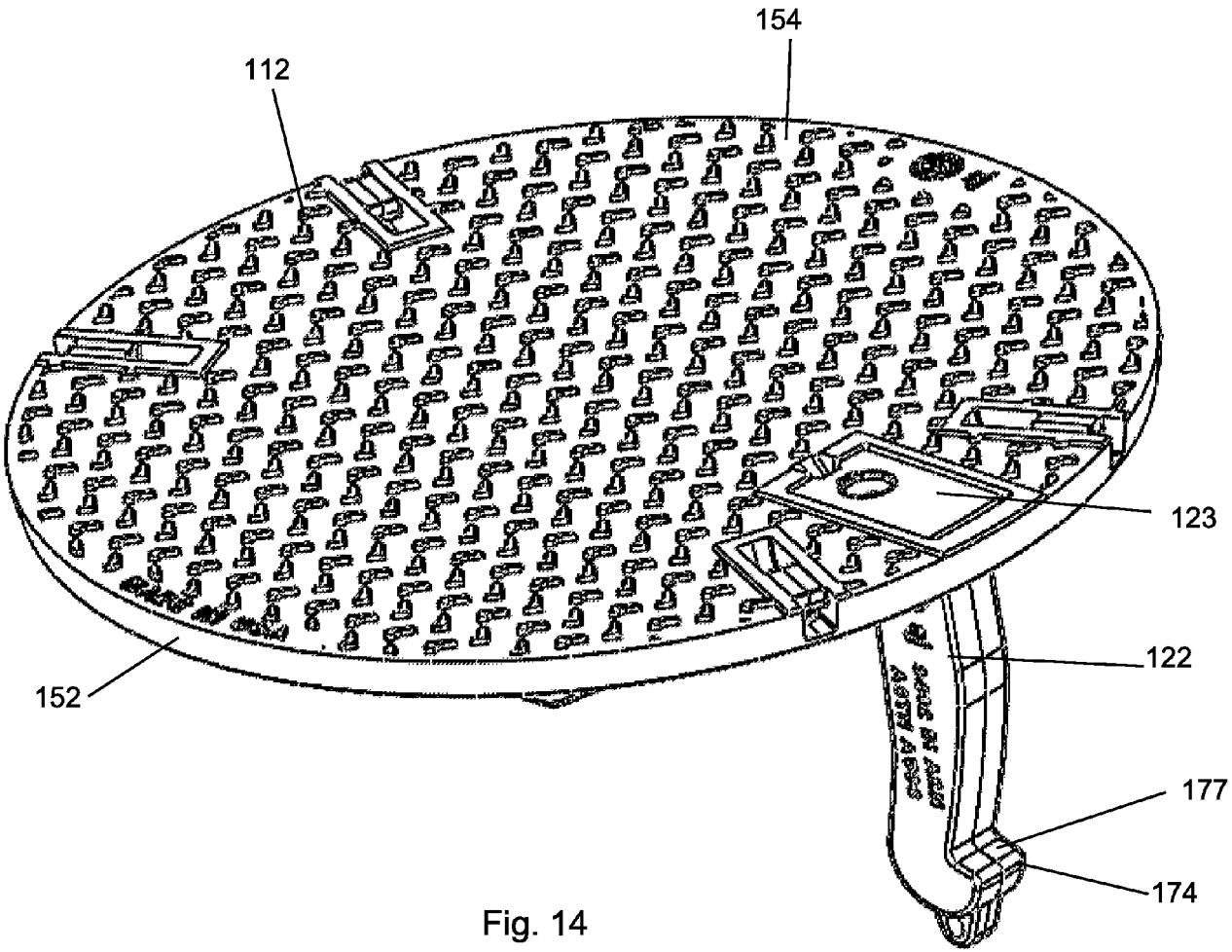
FIG. 14 is a perspective view of a manhole cover according to a second embodiment of the present invention with the control leg in a restraint mode.
Figure 15:
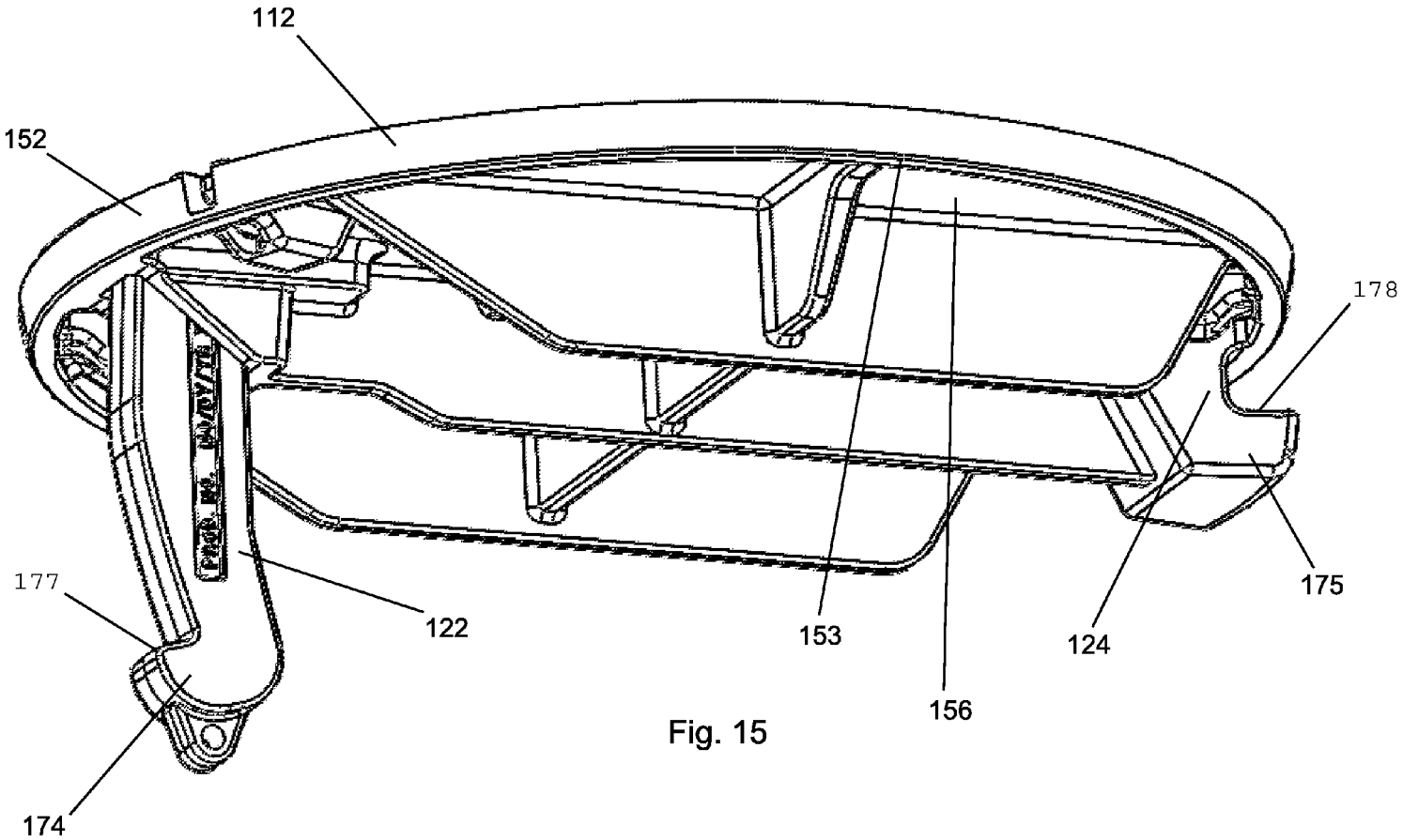
FIG. 15 is a perspective view of a manhole cover according to a second embodiment of the present invention with the control leg in a restraint mode.

In the embodiment illustrated in FIGS. 7-15, the cover 112 includes a pair of legs 122, 124. As in the first embodiment, the legs 122, 124 may be configurable between two modes: a removal mode and a restraint mode. As shown in the illustrated embodiments of FIG. 7-12, the legs 122, 124 are configured in the restraint mode such that movement of the cover 112 with respect to the frame 114 may be limited. For example, the manhole cover 112 may move from a seated position as shown in FIG. 12 to an unseated position as shown in FIG. 10. The illustrated embodiment of FIG. 13 shows the cover 112 configured in a removal mode, enabling the cover 112 to be removed from the frame 114.

As illustrated, each of the legs 122, 124 includes a foot 174, 175 respectively. The feet may be integrally cast as part of each leg during manufacture. The feet 174, 175 may extend radially outwardly toward the peripheral edge 152 of the cover 112, and each may include a frame-stop surface 177, 178 that may be configured to contact the frame 114 in order to limit displacement of the cover 112 with respect to the frame 114. The feet 174, 175 may project radially outwardly beyond the peripheral edge 152 of the cover 112 in order to be aligned underneath the frame 114. The feet 174, 175 are thus aligned vertically underneath the frame 114, at least when the cover 112 is in the restraint mode. For example, the feet 174, 175 may contact the underside of the frame supporting surface 142 limiting movement of the cover 112 in an explosion event. In one embodiment at least one of the legs 122 may include an angled guide surface 172; however, the angled guide surface of the leg 122 may be provided with a generally curved, convex shape. This shape may aid in holding the cover 112 tightly against the frame 114, particularly in the area of the second leg 124, as the cover 112 moves through an angular range of motion.

As illustrated, leg 122 may be the same as or similar to the leg 22 of the first embodiment, wherein it can be fixedly anchored to the cover 112 in the restraint mode while being slidably coupled to the cover 112 in the removal mode. This leg thus determines whether or not the cover 112 is in the restraint mode or the removal mode. The control leg 122 may include a projection 123, or lug, having a hole 125 capable of being fastened with an anchor bolt 127 to the cover 112 so that the control leg 122 is fixedly anchored to the cover 112. This fastens the leg 122 to the cover 112 and prevents the unwanted movement of the leg 122. However, it should be understood that the control leg 122 need not be fixedly anchored to the cover 112 in order to limit movement of the cover 112 with respect to the frame 114 in response to increased pressure. If the anchor bolt 127 or a fastener for the control leg 122 is misplaced, damaged or defective, the cover 112 and the control leg 122 may remain inherently capable of limiting movement of the cover 112. In other words, without the control leg 122 fixedly anchored to the cover 12, the cover 112 may be in the removal mode but still configured for limited movement during an explosion event. For instance, if the anchor bolt 127 is not present, the projection 123 may interface with the cover 112 to enable the cover 112 to behave as a relief valve.

The leg 122 may be inserted through a control leg anchor opening 158 defined in the cover 112 from the upper surface 154 to the underside 156. When the control leg is not secured to the cover 112 (i.e., in the removal mode) the control leg 122 may slide within this opening 158 so that the control leg 122 can be slid up and away from the frame 114, thereby enabling removal of the cover 112 from the frame 114. The movement of the leg 122 is similar to that of the first embodiment, wherein the leg 122 can move vertically, such that the upper end of the leg including the lug 123 extends out of the upper surface 154 of the cover 112, as well as pivotally, wherein the foot 174 moves radially inwardly so that it is no longer aligned vertically underneath the frame 114. For example, by using the projection 123 as a handle to pull the cover 112 from the frame 114, the second leg 124 may rotate about the frame 114 to a position where the cover 112 is freed from the frame 114 so that it can be removed. The control leg 122 may include a pin 121 that prevents the control leg 122 from sliding completely through the opening 158 in the removal mode. This pin 121 may be installed during manufacture after the control leg 122 is inserted through the opening 158.

As shown in FIGS. 10-13 and 15, in this second embodiment, the second leg 124 is spaced from the control leg 122 and also shorter in length than the control leg 122. In the illustrated embodiment, the second leg is positioned diametrically opposite the control leg 122. Alternatively, the second leg 124 may be spaced in a different location, and the cover 112 may include multiple second legs 124 to aid retaining the cover 112. One result of this variation is that the cover 112—upon experiencing a threshold level of pressure on the underside—will be displaced to open in an angular fashion with respect to the frame 114. The portion 200 of the cover 112 proximate the longer control leg 122 is capable of a range of movement determined by the length of the control leg 122, which in the illustrated embodiment may be 8". This portion 200 of the cover thus is capable of clearing the frame 114—with the underside 156 of the cover 112 above the upper edge 140 of the frame 114. The portion 202 of the cover 112 proximate the shorter second leg 124 has a smaller range of movement than the portion 200. In the illustrated embodiment, the length of the second leg 124 is controlled such that the foot 175 of the second leg 124 contacts the frame 114 when the cover 112 is closed. More particularly, as shown in FIG. 12, the foot 175 may include a curved contact surface 178, such that a distal portion 179 contacts the frame 114 when the cover is closed. This configuration enables the portion 202 of the cover 112 to rotate about the frame mount flange 142, which extends between the foot 175 and the underside 156 of the cover 112. The curved surface 178 may provide clearance that enables such rotation. In this configuration, the portion 202 of the cover 112 proximate the second leg 124 undergoes essentially no vertical movement when the portion 200 is displaced, and the portion 202 of the cover 112 proximate the second leg 124 does not clear the frame 114. In an alternative embodiment, the second leg 124 may be longer than that shown in the illustrated embodiment, for example, to interfit with a different frame 114 that may have a wider support flange 142, or to provide some degree of vertical displacement for the second leg 124 and the portion 202 of the cover 112 proximate thereto.

The angular displacement of the cover 112 can be advantageous in that it limits the direction in which exiting fluids can flow. Instead of allowing fluids to escape through a 360 degree range, the angular displacement of the cover reduces the circumferential range that exiting fluids can flow. In addition, it is possible to orient the cover 112 during installation to direct any gases or flames that may exit the cover assembly 100 during an explosion event. For example, in an arrangement wherein a cover assembly 100 is installed on a sidewalk near a building, the cover 112 may be keyed, for example, by cooperating structure on the frame and cover, such that the longer leg 122 must face the building, such that when the cover 112 is displaced angularly upon the pressure under the cover reaching a threshold, escaping gases, fluids and flames will be directed toward the building rather than toward the open sidewalk which may be likely to contain people.

In operation, the cover 112 of the second embodiment may be configured between two modes: a restraint mode and a removal mode. In the restraint mode, the cover 112 may behave as a relief valve, displacing angularly in response to a pressure on the underside 156 exceeding a threshold and enabling fluid to vent through the access opening 115. The cover 112 may return to a seated position on the frame 114 after the pressure has subsided. In this way, if an explosion event occurs, damage to the manhole cover assembly 100 and surrounding structure, such as the road or the underground area, may be prevented or mitigated. The pressure threshold resulting in displacement of the cover 112 may vary from application to application, generally depending on the weight of the cover 112, and to the extent there are other fluid paths from the underground area.

To place the cover 112 in the restraint mode, the second leg 124 may be placed within the access opening 115 and interfitted with the frame 114 such that the foot 175 extends underneath a portion of the frame 114. Next, the control leg 122 may slide within the control leg anchor opening 158 until the projection 123 of the control leg 122 contacts the upper surface 154 of the cover 112. An anchor bolt 127 may fasten the control leg 122 to the cover 112 so that the control leg 122 is stationary. It should be appreciated that fastening systems other than an anchor bolt 127 may be used to anchor the control leg 122 to the cover 112, and that the present invention is not limited to using an anchor bolt 127. Further, in one embodiment, the anchor bolt 127 or other fastener may be configured to be tamper resistant so that the cover 112 may be considered an unauthorized access deterrent. As an example, in embodiments in which the anchor bolt 127 is a bolt, the bolt may be a penta-head bolt or another bolt type capable of deterring unauthorized access.

With the cover in the restraint mode, the cover 112 may have a limited range of movement with respect to the frame 114 such that it may behave as a relief valve. The cover 112, however, may not be removed completely from the frame 114 without being reconfigured into the removal mode. For example, the feet 174, 175 may be aligned underneath the frame 114 and thus interfere with a portion of the frame 114 preventing vertical movement of the cover 112 beyond a certain point with respect to the frame 114. A portion of the peripheral wall 116 of frame 114, such as a flange, may be circular, and the feet 174, 175 may be arranged such that a circle circumscribed about the feet 174, 175 has a diameter larger than an inner diameter of the peripheral wall 116. A circle circumscribed about the angled-guide surfaces 171, 172, however, may have a diameter less than that of the peripheral wall 116.

Removal of the cover 112 may be enabled by configuring the cover into the removal mode. In this mode, any fastener holding the control leg 122 in place may be loosened or removed so that the control leg 122 may clear the frame 114. The cover may be pivoted open until the second leg 124 is capable of clearing the frame 114. With the legs 122, 124 in this configuration, the cover 112 may be removed from the frame 114 in order to access the manhole or underground area.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A manhole cover adapted to move from a seated position to an unseated position with respect to a frame to relieve pressure, the frame having a manhole cover receiving surface and a peripheral wall defining an access opening, said manhole cover comprising:

a cover portion having an upper face, an outer peripheral edge, and an underside opposing said upper face, said cover defining an opening extending through said cover;

a first leg and a control leg extending from said cover portion whereby said control leg is configurable between a restraint mode and a removal mode, wherein said first leg and said control leg extend away from said underside toward said access opening and each includes a foot at a first end thereof, said feet of said first leg and said control leg projecting radially outwardly underneath the peripheral wall in said restraint mode;

whereby in response to pressure on said underside reaching a threshold in said restraint mode, at least a portion of said cover portion displaces from said seated position to said unseated position such that fluid flows through the access opening;

wherein in said unseated position and in said restraint mode, said first leg, said control leg, and said feet cooperate with the frame to enable said at least a portion of said cover portion to have a range of movement with respect to the manhole receiving flange, wherein said feet contact the frame at a limit of said range to prevent said cover portion from moving beyond said limit of said range; and wherein in said removal mode said control leg is slidable within said opening in said cover such that said control leg is movable away from the frame to enable removal of said manhole cover therefrom.

2. The manhole cover as claimed claim 1 wherein said first leg is shorter than said control leg, such that in response to pressure on said underside reaching a threshold in said restraint mode, a portion of said cover proximate said control leg moves upwardly to clear the frame and permit fluid flow through said access opening and a second portion of said cover proximate said first leg does not move upwardly a sufficient distance to clear said cover.

3. The manhole cover as claimed in claim 1 wherein a portion of said first leg contacts said frame when said cover is in said restraint mode.

4. The manhole cover as claimed in claim 1 wherein said control leg includes an anchor lug configured to fasten to said cover portion in said restraint mode such that said control leg is locked in place in said restraint mode.

5. The manhole cover as claimed in claim 4 wherein said anchor lug of said control leg is a handle that enables a person to pull the manhole cover from the frame.

6. The manhole cover as claimed in claim 1 wherein said control leg includes a convex angled surface configured to interface with the peripheral wall of the frame in order to prevent separation between said first leg and said frame as said cover moves within said range of motion as fluid is vented from the access opening in said unseated position.

7. The manhole cover as claimed in claim 1 wherein said limit of said range is 8 inches between said underside of said portion of said cover and the manhole receiving flange.

8. The manhole cover as claimed in claim 1 wherein said manhole cover is adapted to fit a pre-existing frame without modification thereto.

9. The manhole cover as claimed in claim 1 wherein in said removal mode, said first leg, said control leg, and said feet are capable of limiting movement of said cover portion with respect to the manhole receiving flange in response to an explosion event.

10. A manhole cover adapted to behave as a relief valve to relieve pressure, said manhole cover movable from a seated position to an unseated position with respect to a frame, the frame having a peripheral wall defining an access opening, said manhole cover comprising:

a cover portion having an upper surface, an outer peripheral edge, and an underside opposing said upper surface;

a control leg extending from said underside of said cover portion and including a foot extending radially outwardly from said control leg to a position underneath said frame, said foot spaced vertically below said frame to permit at least a portion of said cover proximate said control leg to have a range of movement, such that said portion of said cover is capable of moving within said range of movement upon a pressure level on said underside reaching a threshold, said foot contacting said frame at a limit of said range of movement wherein said portion of said cover clears said frame to permit fluid flow from said access opening; and a first leg extending from said underside of said cover portion, said first leg spaced from said control leg, said first leg including a foot extending radially outwardly from said first leg to a position beneath said frame, said foot on said first leg contacting said frame to prevent a portion of said cover proximate said first leg from clearing said frame.

11. The manhole cover as claimed in claim 10 further comprising:

an opening through the cover portion from said upper surface to said underside;

said control leg coupled to said cover portion and configurable between a restraint mode and a removal mode, said control leg adapted to slide within said opening in said removal mode and adapted to fasten to said cover portion in said restraint mode such that said control leg is locked in place in said restraint mode.

12. The manhole cover as claimed in claim 10 wherein said control leg includes a convex angled surface configured to interface with the peripheral wall of the frame in order to prevent separation between said first leg and said frame as said cover moves within said range of motion as fluid is vented from the access opening in said unseated position.

13. The manhole cover as claimed in claim 10 wherein said manhole cover is adapted to vent fluid by displacing said portion of said cover proximate said control leg between 2 and 8 inches vertically with respect to the frame.

14. The manhole cover as claimed in claim 10 wherein said foot on said first leg contacts said frame throughout said range of movement of said portion of said cover proximate said control leg.

15. A manhole cover adapted to behave as a relief valve to relieve pressure, said manhole cover movable from a seated position to an unseated position with respect to a frame, the frame having a peripheral wall defining an access opening, the peripheral wall including a cover receiving flange said manhole cover comprising:

a cover having an upper surface, an outer peripheral edge, and an underside opposing said upper surface, said cover defining an opening extending through the cover from said upper surface to said underside;

a first leg extending through said opening in said cover, said first leg including an upper end and a lower end and defining a length therebetween, wherein said upper end includes a lug and said lower end includes a foot extending outwardly from said leg and underneath a portion of said frame, wherein said first leg is slidably movable within said cover opening to a closed position wherein said lug engages said cover and said foot is spaced at a vertical distance below said underside of said cover with said foot extending radially outwardly underneath the frame such that in response to increased pressure a first portion of said cover has a range of movement with respect to the cover receiving flange that is capable of providing a vertical clearance between said first portion of said cover and the frame to enable the escape of fluids through the access opening, wherein said foot contacts the frame at a limit of said range to prevent said first portion of said cover from moving beyond said limit of said range; and a second leg extending from said underside of said cover, said second leg spaced from said first leg, said second leg including an upper end and a lower end defining a length therebetween, said upper end affixed to said underside of said cover and said lower end including a foot outwardly from said second leg and underneath a portion of said frame, said length of said second leg being shorter than said length of said first leg to prevent a second portion of said cover from vertically clearing the frame and causing said cover to open at an angle with respect to the frame in response to movement of said first portion of said cover within said range of motion.

16. The manhole cover of claim 15 wherein said first leg and said second leg are diametrically opposed on said cover.

17. The manhole cover of claim 16 wherein a portion of said foot on said second leg engages the frame when said first leg is in said closed position.

18. The manhole cover of claim 17 wherein said foot of said second leg rotates about a portion of the frame when said first portion of said cover moves within said range of motion.

19. The manhole cover of claim 18 wherein said first leg can be slidably removed from said cover by lifting said lug to pivot said first leg within said cover opening and pulling said first leg through said opening.

20. The manhole cover of claim 19 wherein said length of said first arm is at least four times greater than said length of said second arm.

* * * * *